US007191779B2

(12) United States Patent
Shiue

(10) Patent No.: US 7,191,779 B2
(45) Date of Patent: Mar. 20, 2007

(54) SNORKEL WITH WHISTLER

(75) Inventor: Chih-Cheng Shiue, Escondido, CA (US)

(73) Assignee: QDS Injection Molding LLC, Escondido, CA (US)

( * ) Notice: Subject to any disclaimer, the term of this patent is extended or adjusted under 35 U.S.C. 154(b) by 0 days.

(21) Appl. No.: 11/055,683

(22) Filed: Feb. 11, 2005

(65) Prior Publication Data

US 2006/0180145 A1 Aug. 17, 2006

(51) Int. Cl.
*B63C 11/16* (2006.01)
*B63C 11/02* (2006.01)

(52) U.S. Cl. ..... 128/201.11; 128/201.27

(58) Field of Classification Search ..... 128/201.11, 128/201.27, 201.26, 859, 860, 861
See application file for complete search history.

(56) References Cited

U.S. PATENT DOCUMENTS

| | | | | |
|---|---|---|---|---|
| 3,139,087 | A * | 6/1964 | Liberatore | 128/201.11 |
| 4,380,232 | A * | 4/1983 | Doyle | 128/201.11 |
| 4,938,211 | A * | 7/1990 | Takahashi et al. | 128/204.26 |
| 4,998,499 | A * | 3/1991 | Nordbeck | 116/142 FP |
| 5,165,423 | A * | 11/1992 | Fowler et al. | 128/861 |
| 5,351,681 | A * | 10/1994 | Hudson | 128/201.11 |
| 6,332,424 | B1 * | 12/2001 | Frink | 116/210 |
| 6,332,464 | B1 * | 12/2001 | Chen | 128/204.26 |
| 6,578,511 | B1 * | 6/2003 | Dexter et al. | 116/137 R |
| 2004/0211413 | A1 * | 10/2004 | Monnich | 128/201.11 |

* cited by examiner

*Primary Examiner*—Teena Mitchell
(74) *Attorney, Agent, or Firm*—Troxell Law Office PLLC

(57) ABSTRACT

Provided is a snorkel having a whistler. In one embodiment, the whistler is mounted on a breathing tube. A swimmer wearing the snorkel may seize the whistler by the mouth prior to making a clear, shrill sound by activating the whistler.

5 Claims, 4 Drawing Sheets

SNORKEL WITH WHISTLER

FIELD OF THE INVENTION

The present invention relates to snorkels and more particularly to such a snorkel having a whistler such that a swimmer may seize the whistler by the mouth prior to making a clear, shrill sound by activating the whistler.

BACKGROUND OF THE INVENTION

Conventionally, a snorkel is designed to enable the mouth of a swimmer to breath through a breathing tube having an upper opening above the surface of water while swimming just below the surface of water. It is also understood that water sports is somewhat dangerous. However, means for making a sound for help in case of emergency is not available when snorkeling. Sometimes a person engaged in snorkeling may lose his/her life due to the above reason.

Typically, whistling is a good way for making a sound for help. Thus, constructing a snorkel having a whistler is a novel idea for increasing safety when snorkeling. It is known that a swim mask can cover nose and eyes. Also, a snorkel is typically secured to a mask strap retaining clip at one side of the swim mask. Thus, it is desired to have a whistler formed on a breathing tube of snorkel for facilitating the use of the whistler in case of emergency.

SUMMARY OF THE INVENTION

It is therefore an object of the present invention to provide a snorkel having a whistler mounted on a breathing tube thereof so that a swimmer may seize the whistler by the mouth prior to making a clear, shrill sound by activating the whistler in case of emergency.

It is another object of the present invention to provide a snorkel having a whistler mounted proximate a mouthpiece connected to the breathing tube for facilitating a swimmer seizing the whistler by the mouth prior to making a clear, shrill sound by activating the whistler in case of emergency.

In one aspect of the present invention, a pipe of the breathing tube proximate the mouthpiece is made rotatable with respect to the breathing tube such that a swimmer wearing the snorkel may rotate the whistler on the pipe to quickly seize the whistler by the mouth prior to whistling in case of emergency.

In another aspect of the present invention, the whistler is mounted on a splash protector on a top of the breathing tube so that a swimmer wearing the snorkel may make a clear, shrill sound by activating the whistler by exhaling in case of emergency.

The above and other objects, features and advantages of the present invention will become apparent from the following detailed description taken with the accompanying drawings.

DETAILED DESCRIPTION OF THE PREFERRED EMBODIMENTS

Figure 1:
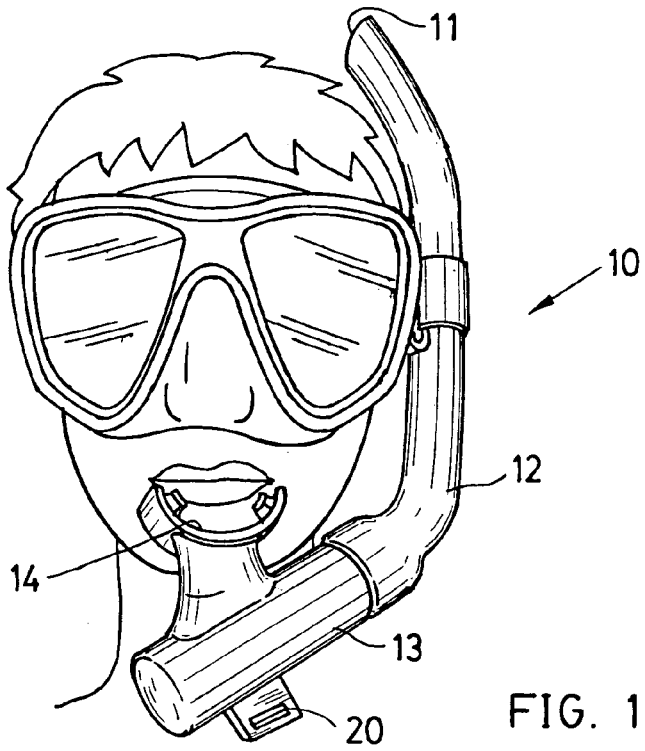
FIG. 1 is an environmental view of a swimmer wearing a snorkel having a whistler according to a first preferred embodiment of the invention.
Figure 2:
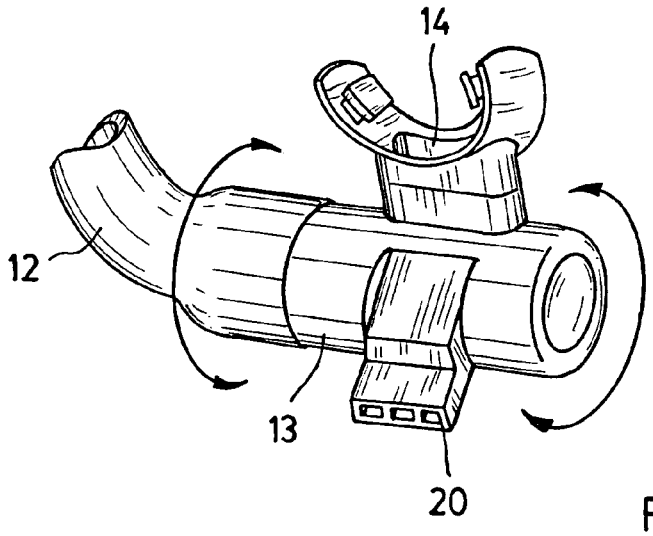
FIG. 2 is a perspective view of a lower portion of the snorkel.
Figure 3:
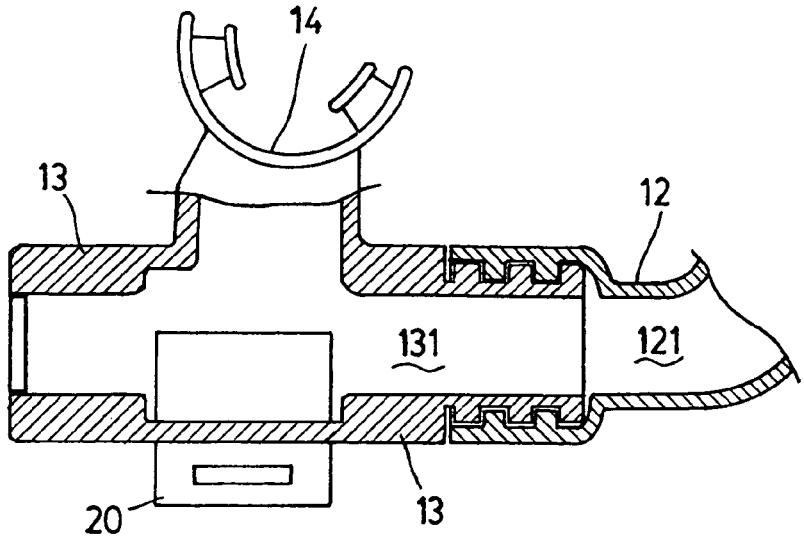
FIG. 3 is a sectional view of FIG. 2.

Referring to FIGS. 1 to 3, there is shown a snorkel constructed in accordance with a first preferred embodiment of the invention. The snorkel comprises a breathing tube 10 and a whistler 20. Each component is discussed in detailed below. The breathing tube 10 is of a conventional type and comprises an upper end 11 being in fluid communication with ambient, a tube member 12, a lower, enlarged pipe 13 rotatably connected to a lower end of the tube member 12 as detailed later, and a mouthpiece 14 projected from an outer surface of the pipe 13 and in fluid communication therewith, and adapted to be seized by the mouth of a swimmer.

The tube member 12 is formed of flexible plastics. Alternatively, the tube member 12 is formed of hard plastics and the pipe 13 is formed of flexible plastics. A joining portion of the tube member 12 and the pipe 13 is waterproof. The characteristics of the invention are that the provision of the whistler 20 as detailed later and the pipe 13 is adapted to rotate about the tube member 12. Note that the rotation may take forms other than above as contemplated by the invention. A channel 121 of the tube member 12 is adapted to communicate with a channel 131 of the pipe 13.

Figure 4:
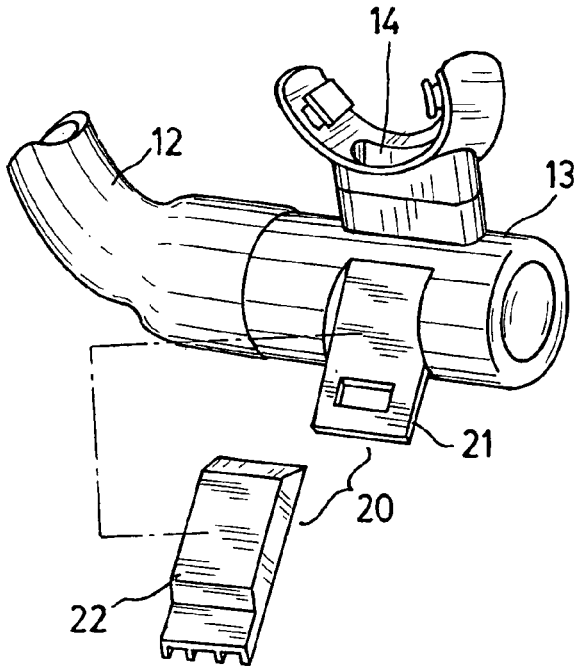
FIG. 4 is a view similar to FIG. 2 with a whistling member of the whistler removed.
Figure 5:
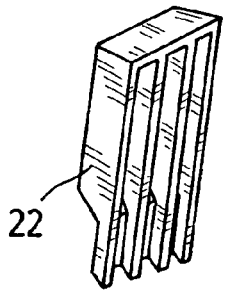
FIG. 5 is a perspective view of the whistling member.

Referring to FIGS. 4 and 5, the whistler 20 comprises a rectangular base 21 and a rectangular whistling member 22 secured to the base 21 by applying adhesive. In the embodiment, the base 21 is formed integrally with the pipe 13 with only a small portion of the channel 131 of the pipe 13 occupied by the base 21. As such, a normal operation of the breathing tube 10 is not interfered by the whistler 20. The whistler 20 described above is only a preferred form. Other forms thereof are also contemplated by the invention.

Figure 6:
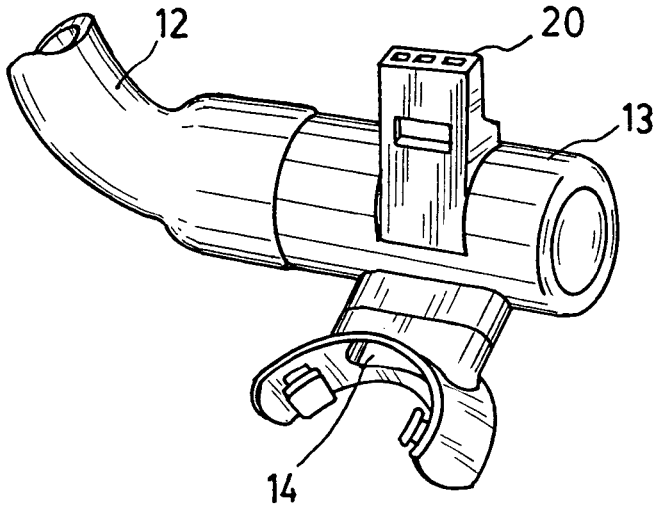
FIG. 6 is a view similar to FIG. 2, where the whistler has been rotated to a ready to use position.
Figure 7:
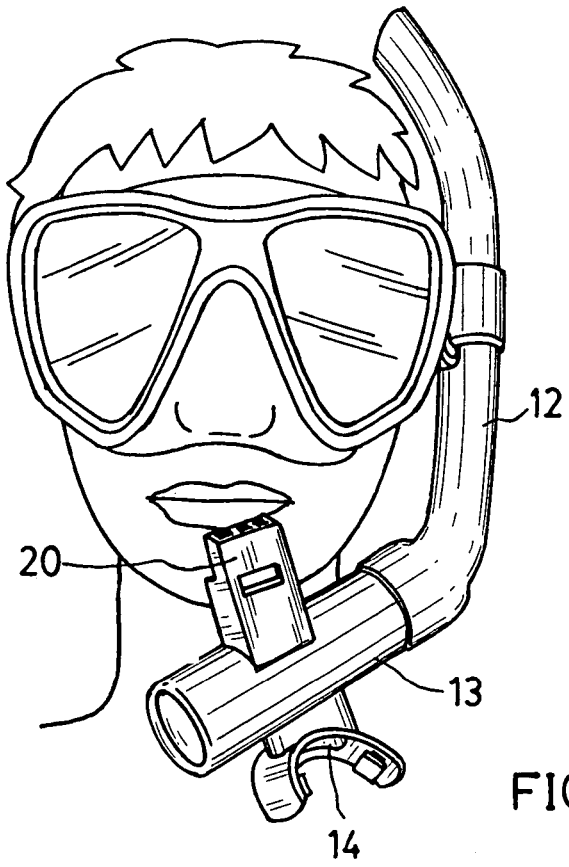
FIG. 7 is a view similar to FIG. 1, where the whistler has been rotated to the ready to use position to be seized by the mouth.

Referring to FIGS. 6 and 7, it shows that the whistler 20 and the pipe 13 have been rotated about the tube member 12 to a ready to use position such that the swimmer may seize the whistler 20 by the mouth and whistle in case of emergency. It is also noted that the breathing tube 10 described above is only a preferred form. Other forms thereof are also contemplated by the invention.

Figure 8:
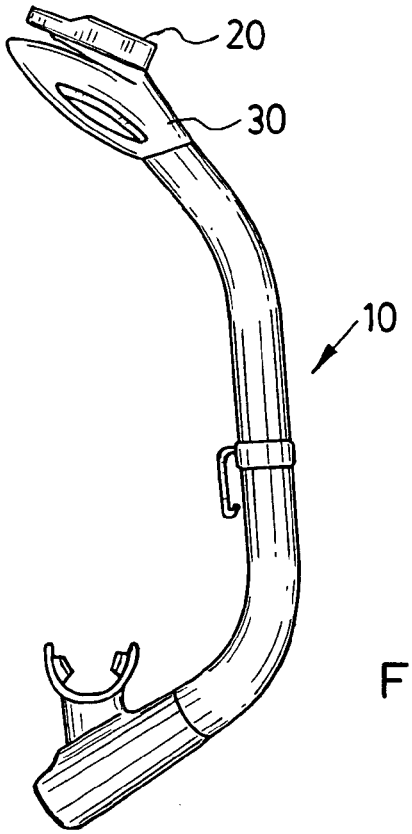
FIG. 8 is a side view of a snorkel having a whistler mounted on a splash protector at an upper end of the breathing tube according to a second preferred embodiment of the invention.

Referring to FIG. 8, a second preferred embodiment of the snorkel according to the invention is shown. The snorkel has a whistler 20 mounted on a splash protector 30 at an upper end of the breathing tube 10. The second embodiment is adapted to make a clear, shrill sound by activating the whistler 20 by exhaling in case of emergency.

Figure 9:
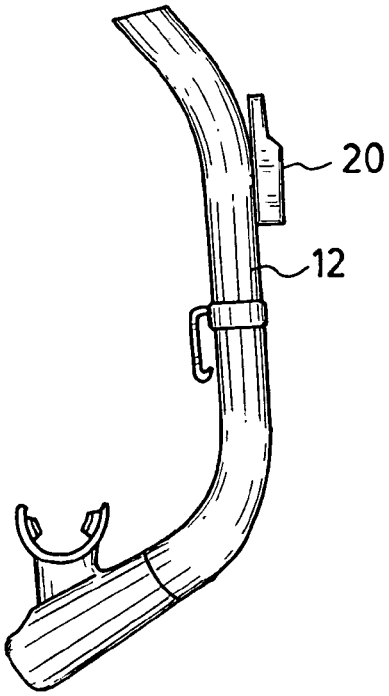
FIG. 9 is a side view of a snorkel having a whistler mounted on an outer surface of the breathing tube according to a third preferred embodiment of the invention.

Referring to FIG. 9, a third preferred embodiment of the snorkel according to the invention is shown. The snorkel has a whistler 20 mounted on an outer surface of the tube member 12 of the breathing tube. The third embodiment is adapted to make a louder sound by activating the whistler in case of emergency.

In brief, in the invention there is provided a snorkel having a whistler 20 mounted on a breathing tube 10 thereof such that a swimmer may seize the whistler by the mouth prior to making a clear, shrill sound by activating the whistler in case of emergency. Further, in a preferred embodiment of the invention the pipe 13 of the breathing tube 10 proximate the mouthpiece 14 is made rotatable with respect to the breathing tube 10 such that a swimmer wearing the snorkel may rotate the pipe 13 to quickly seize the whistler 20 on the pipe 13 by the mouth prior to whistling in case of emergency.

While the invention herein disclosed has been described by means of specific embodiments, numerous modifications and variations could be made thereto by those skilled in the art without departing from the scope and spirit of the invention set forth in the claims.

What is claimed is:

1. A snorkel comprising:

a) a breathing tube having:

i) a tube member having a first channel;

ii) a lower pipe being rotatably connected directly to a first end of the tube member and having a second channel; and iii) a mouthpiece connected to the lower pipe and communicating with the first channel through the second channel; and b) a whistler connected, directly to the lower pipe, wherein the lower pipe is movable between first and second positions by rotating the lower tube relative to the tube member, when the lower pipe is located in the first position, the mouthpiece is positioned for use, and when the lower pipe is located in the second position, the whistler is positioned for use, and further comprising a slash protector connected to a second end of the tube member opposite the mouthpiece and the whistler.

2. The snorkel according to claim 1, wherein the mouthpiece and the whistler are located on opposing sides of the lower pipe.

3. The snorkel according to claim 1, wherein the lower pipe and the tube member are rotatably connected by a waterproof connection.

4. The snorkel according to claim 1, wherein the whistler includes a rectangular base.

5. The snorkel according to claim 1, wherein the whistler includes a rectangular base and a rectangular whistling member.

* * * * *

UNITED STATES PATENT AND TRADEMARK OFFICE

CERTIFICATE OF CORRECTION

PATENT NO. : 7,191,779 B2
APPLICATION NO. : 11/055683
DATED : March 20, 2007
INVENTOR(S) : Chih-Cheng Shiue It is certified that error appears in the above-identified patent and that said Letters Patent is hereby corrected as shown below:

Column 2, line 20
Under "DETAILED DESCRIPTION OF THE PREFERRED EMBODIMENTS", in the above referenced patent application, "detailed" should be "details".

Column 4, line 3
Under "WHAT IS CLAIMED", in "Claim 1", in the above referenced patent application, "lower tube" should be "lower pipe".

Column 4, line 8
"slash" should be "splash".

Signed and Sealed this

Twenty-fourth Day of August, 2010

David J. Kappos

David J. Kappos
*Director of the United States Patent and Trademark Office*